US010632484B2

(12) United States Patent
Tao et al.

(10) Patent No.: US 10,632,484 B2
(45) Date of Patent: Apr. 28, 2020

(54) E-LIQUID BOTTLE FOR ELECTRONIC CIGARETTE

(71) Applicant: Shenzhen Uwell Technology Co., Ltd., Shenzhen (CN)

(72) Inventors: Jia Tao, Shenzhen (CN); Yucheng Xiao, Shenzhen (CN)

(73) Assignee: SHENZHEN UWELL TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/174,313

(22) Filed: Oct. 30, 2018

(65) Prior Publication Data

US 2019/0168246 A1 Jun. 6, 2019

Related U.S. Application Data

(63) Continuation of application No. PCT/CN2017/114664, filed on Dec. 5, 2017.

(51) Int. Cl.
*B05B 11/00* (2006.01)
*A24B 15/167* (2020.01)
(Continued)

(52) U.S. Cl.
CPC ..... *B05B 11/3015* (2013.01); *A24B 15/167* (2016.11); *A24D 3/18* (2013.01);
(Continued)

(58) Field of Classification Search
CPC ..... B05B 11/3047
(Continued)

(56) References Cited

U.S. PATENT DOCUMENTS

2018/0099299 A1* 4/2018 Sun ..... B05B 11/3008
2018/0306180 A1* 10/2018 Chan ..... F04B 13/00

FOREIGN PATENT DOCUMENTS

CN 204560974 U 8/2015
CN 204579892 U 8/2015
(Continued)

OTHER PUBLICATIONS

Written Opinion of the International Searching Authority.
International Search Report for PCT/CN2017/114664.

*Primary Examiner* — Timothy P. Kelly

(57) ABSTRACT

An e-liquid bottle includes a main body for receiving e-liquid therein, and an e-liquid injecting member mounted on a bottleneck of the main body. The e-liquid injecting member includes a sleeve, a chamber formed inside the sleeve for storing e-liquid therein, a single valve connected between the bottleneck and an e-liquid suction portion of the chamber for controlling the e-liquid flow to the chamber, a piston installed in an e-liquid feeding portion of the chamber, an e-liquid guiding pipe formed on the piston and extending into the sleeve, a base mounted on the sleeve to engage with the e-liquid pipe and driven by the piston move back and forth along the chamber to control the pressure in the chamber, an e-liquid feeding tube connected to an e-liquid outlet of the e-liquid guiding pipe. An interval is formed between the piston and the base so that the piston can move along the interval towards the chamber to separate the e-liquid guiding pipe from the base and connect an e-liquid inlet of the e-liquid guiding pipe with the chamber.

9 Claims, 4 Drawing Sheets

(51) Int. Cl.

| | |
|---|---|
| ***A24D 3/18*** | (2006.01) |
| ***B65D 47/00*** | (2006.01) |
| ***A24F 47/00*** | (2020.01) |

(52) U.S. Cl.
CPC ..... *A24F 47/008* (2013.01); *B05B 11/3073* (2013.01); *B05B 11/3094* (2013.01); *B65D 47/00* (2013.01)

(58) Field of Classification Search
USPC ..... 222/321.7
See application file for complete search history.

(56) References Cited

FOREIGN PATENT DOCUMENTS

| | | | |
|---|---|---|---|
| CN | 204742643 | U | 11/2015 |
| CN | 207550723 | U | 6/2016 |
| CN | 105982358 | A | 10/2016 |
| GB | 2531986 | A | 5/2016 |

* cited by examiner

E-LIQUID BOTTLE FOR ELECTRONIC CIGARETTE

CROSS-REFERENCE TO RELATED APPLICATION

The present application is a continuation-application of International Application PCT/CN2017/114664, with an international filing date of Dec. 5, 2017, the contents of all of which are hereby incorporated by reference the contents of all of which are hereby incorporated by reference.

BACKGROUND

1. Technical Field

The present disclosure generally relates to electronic cigarettes field, and especially relates to an e-liquid bottle for supplying e-liquid to an atomizer of an electronic cigarette.

2. Description of Related Art

With the concept of healthy life being deeply rooted in the hearts of people, electronic cigarettes, as a healthily smoking way, are gradually popular at home and abroad. It's well known that e-liquid is necessary to continuously feed into the electronic cigarette during using the electronic cigarette, so a matchable e-liquid bottle provided for the electronic cigarette is appeared. A conventional e-liquid bottle currently used on the market is to feed e-liquid into an atomizer of the electronic cigarette by manually squeezing an e-liquid chamber. However, such e-liquid bottle has some disadvantages: firstly, the required e-liquid injection quantity is difficult to control even though sometimes the e-liquid quantity is suddenly excessive extrusion beyond what's actually needed, especially when using on a drip-type atomizer, thereby resulting in poor experience. Secondly, some kinds of e-liquid bottles are disposable not to be reused.

SUMMARY

The technical problems to be solved: in view of the shortcomings of the related art, the present disclosure relates to an e-liquid bottle used in an electronic cigarette which can be simply operated, re-usable and effectively control the e-liquid injection quantity of the electronic cigarette.

The technical solution adopted for solving technical problems of the present disclosure is:

an e-liquid bottle used in an electronic cigarette includes a main body for receiving e-liquid therein and an e-liquid injecting member mounted on a bottleneck of the main body. The e-liquid injecting member includes a sleeve, a chamber formed inside the sleeve for storing e-liquid therein, a single valve connected between the bottleneck and an e-liquid suction portion of the chamber for controlling the e-liquid in the main body flow to the chamber, a piston installed in an e-liquid feeding portion of the chamber and moving up and down along an axial direction of the chamber, an e-liquid guiding pipe formed on the piston and extending into the sleeve, a base mounted on the sleeve to engage with the e-liquid guiding pipe and driven by the piston move back and forth along the axial direction of the chamber to control the pressure of the chamber, and an e-liquid feeding tube connected to an e-liquid outlet of the e-liquid guiding pipe. An interval is formed between the piston and the base so that the piston can move along the interval towards the chamber to separate the e-liquid guiding pipe from the base and then connect an e-liquid inlet of the e-liquid guiding pipe with the chamber.

Wherein an upper case is installed on an upper portion of the main body for receiving the sleeve therein and the piston extends outward from the top portion of the upper case.

Wherein the piston further includes a pressing block, a barrel received in the sleeve and moved up and down along the axial direction of the chamber, a resetting spring sleeved around the periphery of the barrel and its two opposite ends respectively abutted against the pressing block and a protrusion extending outward from the top end of the barrel, the e-liquid guiding pipe is fixed in the barrel and the pressing block is installed on a top end of the barrel and extending out of the top portion of the upper case.

Wherein the upper case includes an upper cover formed on the top portion thereof for covering the pressing block and the e-liquid feeding tube, each of the pressing block and the upper cover includes a magnet engaged with each other.

Wherein the upper cover further includes a gasket formed on its inner top surface thereof corresponding to the e-liquid feeding tube.

Wherein the base is received in the chamber and sleeved around the periphery of the e-liquid guiding pipe, the interval is formed between the base and a protruding step formed on an inner wall of the barrel.

Wherein the e-liquid guiding pipe includes an annular flange extending upward from a bottom portion of the e-liquid guiding pipe and the base includes a recess formed on its bottom thereof to engage with the annular flange.

Wherein the e-liquid inlet is formed on a bottom wall of the guiding pipe, and the length of the interval along the axial direction of the chamber is at least equal to a vertical distance from the e-liquid inlet to a bottom surface of the base.

Wherein the single valve is received in the bottom of the chamber and covered onto a connection joint between the e-liquid suction portion and the chamber.

Wherein the main body further includes an outer housing, an inner housing received in the outer housing and a sealing member connected between the outer housing and the inner housing, the outer housing includes a hollow structure and the inner housing is a transparent material structure.

The present disclosure provides the advantages as below.

The structure of the present disclosure can realize to conveniently feed e-liquid into the electronic cigarette by simply operating the piston, which is simple and re-usable structure and the e-liquid injection quantity of the electronic cigarette can be effectively controlled according to what's actually needed every time.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

Figure 1:
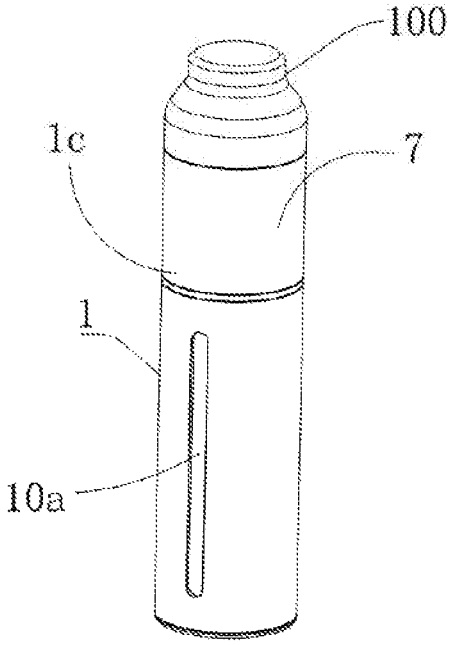
FIG. 1 is a schematic view of the e-liquid bottle for an electronic cigarette in accordance with an exemplary embodiment.

The element labels according to the exemplary embodiment of the present disclosure shown as below:

main body 1, bottleneck 1*a*, e-liquid injecting member 1*b*, upper portion 1*c*, outer housing 10, hollow structure 10*a*, inner housing 11, sealing member 110, sleeve 2, chamber 20, e-liquid suction portion 21, e-liquid feeding portion 22, upper cover 100, inner top surface 100*a*, gasket 100*b*, piston 3, e-liquid guiding pipe 30, bottom portion 30*a*, annular flange 300, e-liquid inlet 31, e-liquid outlet 310, pressing block 32, barrel 33, protrusion 33*a*, protruding step 330, interval 34, resetting spring 35, magnet 36, single valve 4, e-liquid feeding tube 5, base 6, bottom surface 6*a*, recess 60, upper case 7, top portion 7*a*.

DETAILED DESCRIPTION

The disclosure is illustrated by way of example and not by way of limitation in the figures of the accompanying drawings, in which like reference numerals indicate similar elements.

Figure 2:
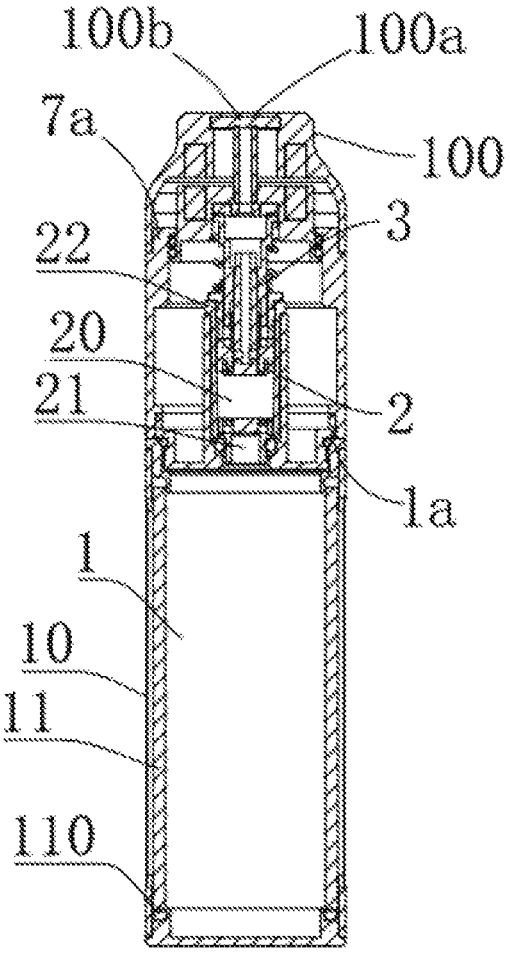
FIG. 2 is an exploded, schematic view of the e-liquid bottle of FIG. 1.
Figure 3:
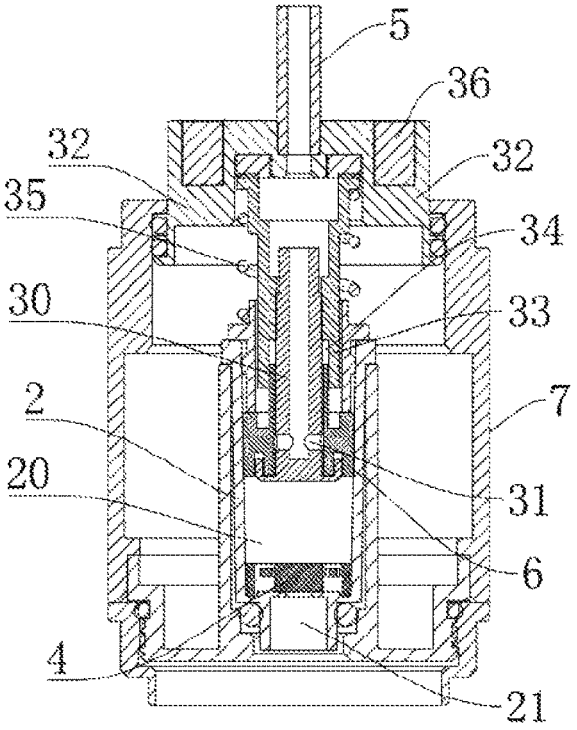
FIG. 3 is an exploded, schematic view of an e-liquid injecting member of the e-liquid bottle of FIG. 1.
Figure 4:
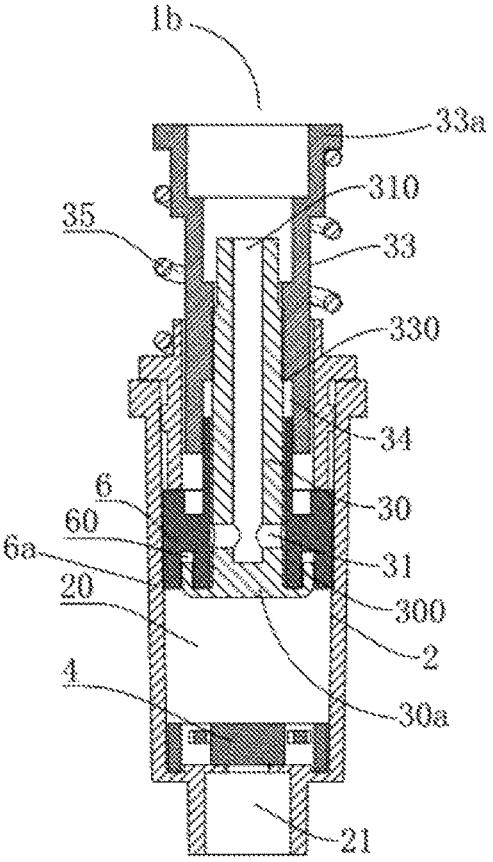
FIG. 4 is an exploded, schematic view of a piston and a sleeve of the e-liquid bottle of FIG. 1.
Figure 5:
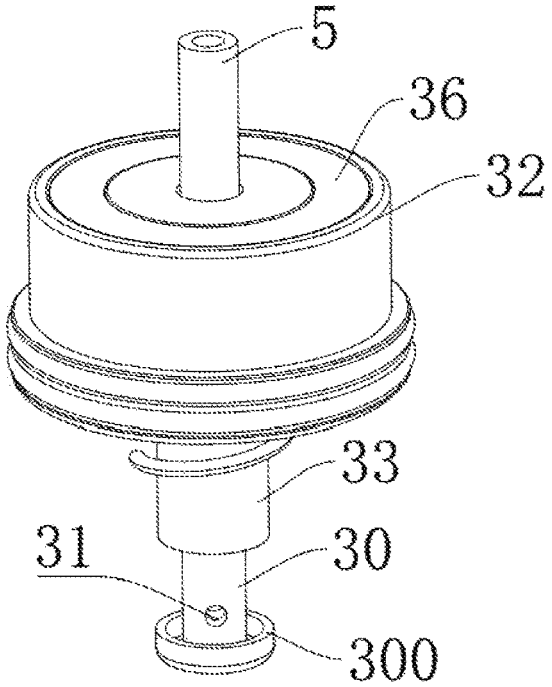
FIG. 5 is a partial exploded, schematic view of the piston of the e-liquid bottle of FIG. 1.
Figure 6:
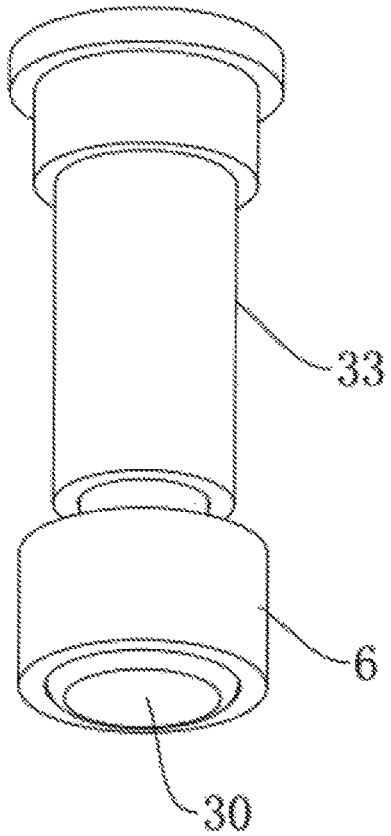
FIG. 6 is a schematic view of a barrel, an e-liquid guiding pipe and a base of the e-liquid bottle of FIG. 1.
Figure 7:
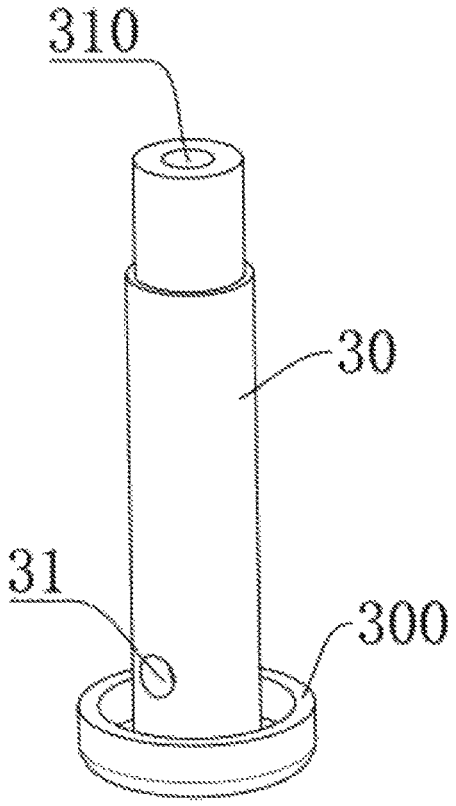
FIG. 7 is a schematic view of the e-liquid guiding pipe of the e-liquid bottle of FIG. 1.
Figure 8:
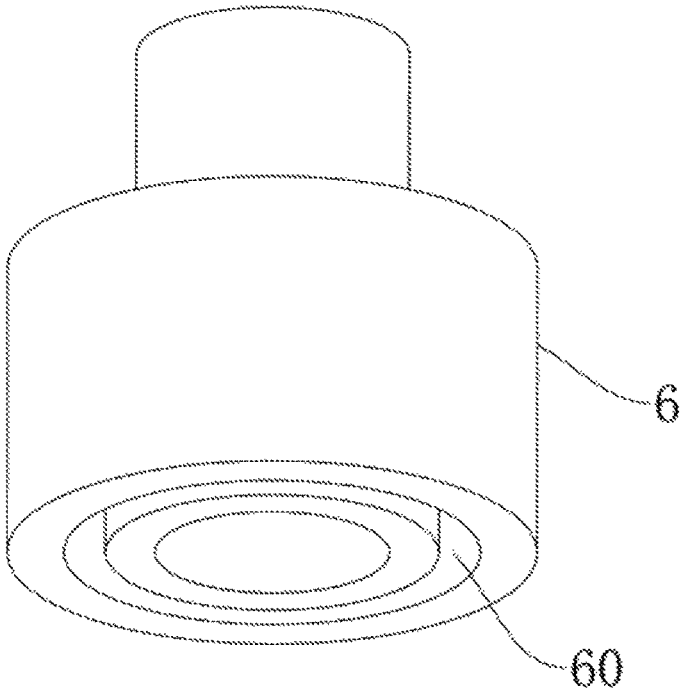
FIG. 8 is a schematic view of the base of the e-liquid bottle of FIG. 1.

Referring to FIGS. 1-8, an e-liquid bottle used in an atomizer of an electronic cigarette in accordance with an exemplary embodiment of the present disclosure is provided. The e-liquid bottle includes a main body 1 for receiving e-liquid therein, and an e-liquid injecting member 1*b* mounted on a bottleneck 1*a* of the main body 1. The e-liquid injecting member 1*b* includes a sleeve 2, a chamber 20 formed inside the sleeve 2 for storing e-liquid therein, a single valve 4 connected between the bottleneck 1*a* and an e-liquid suction portion 21 of the chamber 20 for controlling the e-liquid in the main body 1 flow to the chamber 20, a piston 3 installed in an e-liquid feeding portion 22 of the chamber 20 and moving up and down along an axial direction of the chamber 20, an e-liquid guiding pipe 30 formed on the piston 3 and extending into the sleeve 2, a base 6 mounted on the sleeve 2 to engage with the e-liquid guiding pipe 30 and driven by the piston 3 move back and forth along the axial direction of the chamber 20 to control the pressure of the chamber 20, and an e-liquid feeding tube 5 connected to an e-liquid outlet 310 of the e-liquid guiding pipe 30. An interval 34 is formed between the piston 3 and the base 6 so that the piston 3 can move along the interval 34 towards the chamber 20 to separate the e-liquid guiding pipe 30 from the base 6 and then connect an e-liquid inlet 31 of the e-liquid guiding pipe 30 with the chamber 20.

The e-liquid in the main body 1 passes through the single valve 4 and then flows into the chamber 20, and the piston 3 is driven to move along the axial direction of the chamber 20. Because of the interval 34, the piston 3 is first moved along the interval 34 towards the chamber 20 to separate the e-liquid guiding pipe 30 from the base 6 and then connect with the chamber 20 via the e-liquid inlet 31 of the e-liquid guiding pipe 30. Then, the piston 3 is driven to further move towards the chamber 20 to further push the base 6 close to the bottom of the chamber 20, at this time, the pressure in the chamber 20 is gradually increased (the single valve 4 is provided to prevent the e-liquid from flowing back into the main body 1 from the e-liquid suction portion 21). In this condition, the e-liquid in the chamber 20 flows towards the e-liquid inlet 31 of the e-liquid guiding pipe 30 under the pressure and then flows into the e-liquid feeding tube 5 through the e-liquid outlet 310 of the e-liquid guiding pipe 30, thereby the purpose of e-liquid injection to the electronic cigarette is achieved. In the present disclosure, the e-liquid bottle can be reused and the e-liquid injection quantity is same each time by pressing the piston 3, thereby the quantitative e-liquid injection can be obtained by controlling the movement distance of the piston 3. Generally, the e-liquid quantity by one pressing is between 0.1 ml to 0.3 ml.

In general, an upper case 7 is installed on an upper portion 1*c* of the main body 1 for receiving the sleeve 2 therein for protecting the sleeve 2 and the piston 3 extends outward from the top portion 7*a* of the upper case 7. It can be understood that the upper case 7 and the main body 1 can be assembled together by a screw-thread way or a clamping way, which is convenient to disassemble and achieve the replenishment of e-liquid quantity in the main body 1. In some exemplary embodiments of the present disclosure, the piston 3 further includes a pressing block 32, a barrel 33 received in the sleeve 2 and moved up and down along the axial direction of the chamber 20, a resetting spring 35 sleeved around the periphery of the barrel 33 and its two opposite ends respectively abutted against the pressing block 32 and a protrusion 33*a* extending outward from a top end of the barrel 33. The e-liquid guiding pipe 30 is fixed in the barrel 33 and the pressing block 32 is installed on the top end of the barrel 33 and extending out of the top portion 7*a* of the upper case 7. When operating the e-liquid bottle, force is applied to the barrel 33 and the e-liquid guiding pipe 30 by pressing the pressing block 32 and then both the barrel 33 and the e-liquid guiding pipe 30 are driven to move along the sleeve 2 towards the bottom of the chamber 20 to complete the e-liquid injection operation. After that, the barrel 33, the e-liquid guiding pipe 30 and the base 6 are returned back to their respective original states under the action of the resetting spring 35.

Preferably, the base 6 is received in the chamber 20 and sleeved around the periphery of the e-liquid guiding pipe 30, and the interval 34 is formed between the base 6 and a protruding step 330 formed on an inner wall of the barrel 33. The e-liquid guiding pipe 30 includes an annular flange 300 extending upward from the bottom portion 30*a* of the e-liquid guiding pipe 30 and the base 6 includes a recess 60 formed on its bottom thereof to engage with the annular flange 300. At the same time, the e-liquid inlet 31 can be set on the bottom portion 30*a* of the e-liquid guiding pipe 30.

When the force is applied, the interval 34 causes the e-liquid guiding pipe 30 to move downwardly so that the annular flange 300 is first separated from the recess 60 of the base 6 and the e-liquid guiding pipe 30 is then downwardly extended out relative to the base 6, thereby the e-liquid inlet 31 of the e-liquid guiding pipe 30 is exposed to connect with the chamber 20. When the piston 3 is gradually moved downwardly until it is arrived the end of the interval 34 to contact with the base 6, at this time, the base 6 is pushed to further move downwardly to squeeze against the chamber 20 and further increase the internal pressure of the chamber 20, and then the single valve 4 is closed. In this condition, the e-liquid in the chamber 20 is squeezed from the e-liquid inlet 31 to the e-liquid guiding pipe 30 and then flows into the e-liquid feeding tube 5. When resetting, the resetting spring 35 drives the barrel 33, the pressing block 32 and the e-liquid guiding pipe 30 to move first until the annular flange 300 of the e-liquid guiding pipe 30 matches with the recess 60, at this time, the base 6 is gradually moved upwardly to return its original state, the single valve 4 opens under the action of the pressure and the e-liquid in the main body 1 can flow into the chamber 20. In order to achieve a suitable alignment, the length of the interval 34 along the axial direction of the chamber 20 is at least equal to a vertical distance from the e-liquid inlet 31 to a bottom surface 6*a* of the base 6. Thus, when the piston 3 is moved passing through the interval 34, it can ensure that the e-liquid inlet 31 isn't be obstructed by the base 6 to obtain an effective connection with the chamber 20.

The single valve 4 is a mature structure used in the fluid field for controlling unidirectional movement of fluid to avoid countercurrent flow. In the present disclosure, the single valve 4 is received in the bottom of the chamber 20 and covered onto a connection joint between the e-liquid suction portion 21 and the chamber 20. When the e-liquid bottle is inverted, the e-liquid in the main body 1 can push the valve plate of the valve 4 aside and then flow into the chamber 20 of the sleeve 2. When the e-liquid bottle is turned upright, the e-liquid may push the single valve 4 to close its valve plate, and then the piston 3 is further pressed to generate pressure in the chamber 20 that will further seal the single valve 4 tightly to effectively avoid the e-liquid to flow back into the main body 1.

In some exemplary embodiments of the present disclosure, the upper case 7 includes an upper cover 100 formed on the top portion 7*a* thereof for covering the pressing block 32 and the e-liquid feeding tube 30, which can effectively protect against dust and leakage, and avoid misoperation. Each of the pressing block 32 and the upper cover 100 includes a magnet 36 engaged with each other, through which the magnetic adsorption action of the magnet 36 can effectively prevent the upper cover 100 from loosening and falling. Furthermore, the upper cover 100 further includes a gasket 100*b* formed on its inner top surface 100*a* thereof corresponding to the e-liquid feeding tube 5 to strengthen the sealing effect of the e-liquid feeding tube 5. In addition, a sealing ring can be arranged to enhance the sealing effect such as formed between the pressing block 32 and the upper case 7, the bottleneck 1*a* of the main body 1, and the connection joint between the e-liquid suction portion 21 of the chamber 20 and the bottleneck 1*a* of the main body 1.

In some exemplary embodiments of the present disclosure, the main body 1 further includes an outer housing 10, an inner housing 11 received in the outer housing 10 and a sealing member 110 connected between the outer housing 10 and the inner housing 11. The outer housing 10 includes a hollow structure 10*a* and the inner housing 11 is a transparent material structure, such as glass preferred. The hollow structure 10*a* can not only form beautiful patterns on the outer housing 10, but also take as an observing window to observe the main body 1 through the inner housing 11 so that users can know the current remaining e-liquid quantity in the main body 1 at any time. The sealing member 110 is configured to prevent the e-liquid inside the main body 1 from leaking between the outer housing 10 and the inner housing 11. In general, sealing rings can be installed at the gaps formed between the outer housing 10 and the bottleneck or the bottom of the main body 1, and between the inner housing 11 and the bottleneck or the bottom of the main body 1.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An e-liquid bottle used in an electronic cigarette comprising a main body for receiving e-liquid therein and an e-liquid injecting member mounted on a bottleneck of the main body, the e-liquid injecting member comprising:

a sleeve with a chamber being formed inside the sleeve for storing e-liquid therein;

a single valve connected between the bottleneck and an e-liquid suction portion of the chamber for controlling the e-liquid in the main body flow to the chamber;

a piston installed in an e-liquid feeding portion of the chamber and moving up and down, along an axial direction of the chamber;

an e-liquid guiding pipe formed on the piston and extending into the sleeve;

a base mounted on the sleeve to engage with the e-liquid guiding pipe and driven by the piston move back and forth along the axial direction of the chamber to control the pressure of the chamber;

an e-liquid feeding tube connected to an e-liquid outlet of the e-liquid guiding pipe; and wherein an interval is formed between the piston and the base so that the piston can move along the interval towards the chamber to separate the e-liquid guiding, pipe from the base and then connect an e-liquid inlet of the e-liquid guiding pipe with the chamber; wherein the main body further comprises an outer housing, an inner housing received in the outer housing and a sealing member connected between the outer housing and the inner housing, the outer housing comprises a hollow structure and the inner housing is a transparent material structure.

2. The e-liquid bottle as claimed in claim 1, wherein an upper case is installed on an upper portion of the main body for receiving the sleeve therein and the piston extends outward from the top portion of the upper case.

3. The e-liquid bottle as claimed in claim 2, wherein the piston further comprises a pressing block, a barrel received in the sleeve and moved up and down along the axial direction of the chamber, a resetting spring sleeved around the periphery of the barrel and its two opposite ends respectively abutted against the pressing block and a protrusion extending outward from the top end of the barrel, the e-liquid guiding pipe is fixed in the barrel and the pressing block is installed on a top end of the barrel and extending out of the top portion of the upper case.

4. The e-liquid bottle as claimed in claim 3, wherein the upper case comprises an upper cover formed on the top portion thereof for covering the pressing block and the e-liquid feeding tube, each of the pressing block and the upper cover comprises a magnet engaged with each other.

5. The e-liquid bottle as claimed in claim 4, wherein the upper cover further comprises a gasket formed on its inner top surface thereof corresponding to the e-liquid feeding tube.

6. The e-liquid bottle as claimed in claim 1, wherein the base is received in the chamber and sleeved around the periphery of the e-liquid guiding pipe, the interval is formed between the base and a protruding step formed on an inner wall of the barrel.

7. The e-liquid bottle as claimed in claim 6, wherein the e-liquid guiding pipe comprises an annular flange extending upward from a bottom portion of the e-liquid guiding pipe and the base comprises a recess formed on its bottom thereof to engage with the annular flange.

8. The e-liquid bottle as claimed in claim 7, wherein the e-liquid inlet is formed on a bottom wall of the guiding pipe, and the length of the interval along the axial direction of the chamber is at least equal to a vertical distance from the e-liquid inlet to a bottom surface of the base.

9. The e-liquid bottle as claimed in claim 1, wherein the single valve is received in the bottom of the chamber and covered onto a connection joint between the e-liquid suction portion and the chamber.

* * * * *